US012207748B2

(12) United States Patent
Lemieux

(10) Patent No.: US 12,207,748 B2
(45) Date of Patent: Jan. 28, 2025

(54) APPARATUS FOR BEDDING CLIMATE CONTROL SYSTEM AND METHOD TO USE THE SAME

(71) Applicant: 9381-6031 Québec Inc., Longueuil (CA)

(72) Inventor: Marc-André Lemieux, Longueuil (CA)

(73) Assignee: 9381-6031 Québec Inc., Longueuil (CA)

( * ) Notice: Subject to any disclaimer, the term of this patent is extended or adjusted under 35 U.S.C. 154(b) by 992 days.

(21) Appl. No.: 17/269,868

(22) PCT Filed: Aug. 20, 2019

(86) PCT No.: PCT/CA2019/051131
§ 371 (c)(1),
(2) Date: Feb. 19, 2021

(87) PCT Pub. No.: WO2020/037405
PCT Pub. Date: Feb. 27, 2020

(65) Prior Publication Data

US 2021/0177166 A1 Jun. 17, 2021

Related U.S. Application Data

(60) Provisional application No. 62/720,582, filed on Aug. 21, 2018.

(51) Int. Cl.
*A47G 9/02* (2006.01)
*A47C 21/04* (2006.01)
(Continued)

(52) U.S. Cl.
CPC ..... *A47G 9/0215* (2013.01); *A47C 21/044* (2013.01); *A47C 21/048* (2013.01);
(Continued)

(58) Field of Classification Search
CPC ..... F24H 3/0405; F24H 9/12; F24C 15/006; F24C 15/322; F24C 15/325; F24C 15/166;
(Continued)

(56) References Cited

FOREIGN PATENT DOCUMENTS

CA 2801025 A1 12/2011
CN 108980965 A 12/2018
(Continued)

OTHER PUBLICATIONS

International Search Report for corresponding PCT/CA2019/051131 filed on Aug. 20, 2019.

*Primary Examiner* — Phuong T Nguyen
(74) *Attorney, Agent, or Firm* — Damien Calvet; Gowling WLG (Canada) LLP

(57) ABSTRACT

The invention allows producing air flow to either inflate a self-making bedding system via a first outlet, or to heat the air exiting the apparatus via a second, optionally a third, outlet, for controlling the air flow and the temperature sent into the self-making bedding system. The 5 apparatus is operated via an interface on the outside surface of the apparatus; a smartphone or tablet, an intelligent virtual/personal assistant or a computer including an application or software for wirelessly sending instructions to the apparatus, e.g. using Bluetooth™ or Wifi; or a remote control. The invention is particularly useful for disabled persons for self-making their bed by directly controlling the apparatus via the application, with the possibility to use a 0 voice control system combined with the application, or to have the apparatus daily programmed for making the bed or controlling the temperature at specific time of the day.

20 Claims, 15 Drawing Sheets

(51) Int. Cl.

| | |
|---|---|
| ***A47C 31/00*** | (2006.01) |
| ***F24H 3/04*** | (2022.01) |
| ***F24H 9/12*** | (2022.01) |

(52) U.S. Cl.
CPC ..... *A47C 31/008* (2013.01); *A47G 9/0223* (2013.01); *F24H 3/0405* (2013.01); *F24H 9/12* (2013.01)

(58) Field of Classification Search
CPC ..... F24C 15/16; F24C 7/082; H05B 6/6435; H05B 6/642; A47G 9/0215; A47G 9/0223; A47C 21/044; A47C 21/048; A47C 31/008
USPC ..... 219/212, 391, 393, 395, 398, 400, 410, 219/411, 413
See application file for complete search history.

(56) References Cited

FOREIGN PATENT DOCUMENTS

| | | | | | |
|---|---|---|---|---|---|
| GB | 716746 | A | | 10/1954 | |
| KR | 200456682 | Y1 | | 11/2011 | |
| KR | 20160036467 | | * | 4/2016 | ..... F24F 7/06 |
| KR | 20160036467 | A | | 4/2016 | |
| WO | 2018064776 | A1 | | 4/2018 | |

* cited by examiner

APPARATUS FOR BEDDING CLIMATE CONTROL SYSTEM AND METHOD TO USE THE SAME

CROSS-REFERENCE TO RELATED APPLICATIONS

The present non-provisional patent application is a U.S. National Phase of International Patent Application PCT/CA2019/051131, filed Aug. 20, 2019, which is hereby incorporated by reference in its entirety and which claims the benefits of priority of U.S. Patent Application No. 62/720,582, entitled "Apparatus for bedding climate control system and method to use the same", and filed at the U.S. Patent Office on Aug. 21, 2018, the content of which is incorporated herein by reference.

TECHNICAL FIELD

The present invention relates to a home appliance, in particular an apparatus that provides air and/or heated air to a bedding control system.

BACKGROUND

The inventor has developed a self-making bedding system including a climate control system for the automation and ventilation of an existing duvet, comforter or blanket, as disclosed in international patent application no. WO 2018/064776 (Lemieux), the content of which is incorporated herein by reference. The bedding system comprises an inflatable lining configured to be inserted and affixed into a cover of a duvet together with the duvet. The inflatable lining comprises a network of pneumatic chambers defining a plurality of openings extending through the lining allowing air to circulate through the lining. The bedding system also comprises an apparatus operatively connected to the inflatable lining for blowing air into the network of pneumatic chambers, so as in use, the inflatable lining is inflated to allow for the duvet and its cover to be straightened back into position after every use of the duvet. The inflatable lining may define a second network of pneumatic chambers configured to circulate and distribute hot or cold air towards a user laid in a bed under the duvet so as to regulate the temperature of the duvet. The second network may comprise more than one separate sub-networks, for instance two or four, for distributing air with different temperatures in specific regions of the bed. The lower layer of the inflating lining may comprise a plurality of holes in connection with the second network for distributing the temperature-controlled air.

There is thus a need for a new apparatus allowing to simultaneously (1) providing air to the lining to allow for the duvet and its cover to be straightened back into position after every use of the duvet, and (2) controlling the temperature in the bedding system by providing heated air to the different networks and sub-networks of the bedding system.

SUMMARY

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The invention is directed to an apparatus as described herein allowing to simultaneously providing air to a bedding system, and controlling the temperature of the bedding system.

According to a first aspect, the invention is directed to an apparatus for producing controlled air flows with different temperatures, the apparatus comprising: a blower unit having at least one air moving unit to generate air flow; an outlet unit comprising at least two air outlets fluidly connected to the blower unit and configured for providing the air flow outside the apparatus, each outlet comprising a valve for controllably closing the outlet to control the air flow going through the outlet; a heating unit comprising at least one heating element operatively connected to at least one of the outlets for heating the air flow circulating through the outlet; and a control unit operatively connected to the at least one air moving unit, to the valves and to the at least one heating element, for selectively controlling the air flow and temperature exiting each of the at least two outlets. Preferably, the air moving unit consists of a single centrifugal fan.

According to a preferred embodiment, the apparatus comprises three air outlets, wherein two of said three air outlets are equipped with one of the at least one heating element. With this configuration, the outlet not equipped of a heating system will be only used to inflate the bedding system where the two other outlets equipped with a heating element will be used to climate the bedding system. In that sense, the heating elements are preferably independently controlled one to the other allowing controlling the temperature of each side of the bed independently.

According to a preferred embodiment, the apparatus further comprises a longitudinal distribution pipe for connecting the outlets to the blower unit defining a longitudinal direction, the outlets being fluidly connected along the distributions pipe and perpendicularly oriented to the longitudinal direction of the distribution pipe.

According to a preferred embodiment, each air outlet comprises: a first chamber in fluid communication with the blower unit, and a second chamber in fluid communication with the first chamber and configured for providing the air flow outside the apparatus; and wherein the valve is configured to controllably close the first chamber to avoid the air flow generated by the blower unit to enter the second chamber. Preferably, the first and second chamber of each outlet form a continuous tubular element defining a tubular section with a cylindrical surface, each valve comprising a revolving disc fitting in size with the tubular section of the first chamber. The disc can be maintained inside the first chamber by a vertical pivot allowing the disc to rotate inside the first chamber between a closed position, when the disc closes the first chamber and blocks the air flow, and a full open position, when the disc is parallel to a direction of the air flow, the disc being maintained according to an operative position between the close and full open positions, the operative position being controllably modified by the control unit for modulating the air flow. Preferably, the at least one heating element is located around the cylindrical surface of the second chamber.

According to a preferred embodiment, each disc of each valve is rotated via an actuator comprising a micro-motorized element operatively controlled by the control unit and acting on the vertical pivot of the disc via a cable, each of the motorized element being independent one to the other.

According to a preferred embodiment, the control unit comprises an electronic control system having a printed circuit board (PCB) operatively connected to: the blower unit for controlling a power of the least one air moving unit (on/off) and optionally the air flow; each actuator of the valve for controlling and maintaining the operative position of the valve, and as such control the air flow in each second chamber independently one to the other; and to each heating element for heating or not the air going through the second chamber. Preferably, the electronic control system is operated using at least one of the followings: an interface located on an outside surface of the apparatus; a smartphone, a tablet, an intelligent virtual/personal assistant, or computer including an application or software adapted for wirelessly sending instructions to the apparatus; and a remote control. More preferably, the instructions are wirelessly sent using Bluetooth or Wi-Fi.

According to a preferred embodiment, the apparatus further comprises: a casing for supporting the blower unit, the outlet unit, the heating unit and the control unit; and a grid element extending from a first side of the casing adjacent to the outlet unit, the grid element having at least one air flow opening for allowing air entering the casing; wherein a second side of the casing opposite to the first side is located adjacent to the blower unit, the air entering the casing of the apparatus through the first grid element being then forced to flow above or below the outlets before reaching the blower unit, in order to reduce noise propagation when the apparatus is running. Preferably, the casing is compact enough to be placed under a bed. For instance, the dimensions of the casing can be 3.25 inches (or 8.25 cm), 17.5 inches (or 44.45 cm) and 10.5 inches (or 26.67 cm).

According to a first aspect, the invention is directed to a method for producing controlled air flows with different temperatures, the method comprising:

a) generating an air flow with at least one air moving unit (preferably with one air moving unit consisting of a single centrifugal fan);
b) conducting the air flow generated in step a) outside the apparatus through at least two air outlets, each outlet comprising a valve for controllably closing the outlet to control the air flow going through the outlet, and at least one heating element operatively connected to at least one of the outlets for heating the air flow circulating through the outlet; and
c) selectively and independently controlling the air flow and temperature exiting each of the at least two outlets by controlling the at least one air moving unit, the valves and the at least one heating element.

The invention is particularly useful for disabled persons for self-making their bed by directly controlling the apparatus via the application, with the possibility to use a voice control system combined with the application, or to have the apparatus daily programmed for making the bed or controlling the temperature at specific time of the day.

Other and further aspects and advantages of the present invention will be better understood upon the reading of the illustrative embodiments about to be described or will be indicated in the appended claims, and various advantages not referred to herein will occur to one skilled in the art upon employment of the invention in practice.

BRIEF DESCRIPTION OF THE DRAWINGS

Further features and exemplary advantages of the present invention will become apparent from the following detailed description, taken in conjunction with the appended drawings, in which.

DETAILED DESCRIPTION

Figure 1:
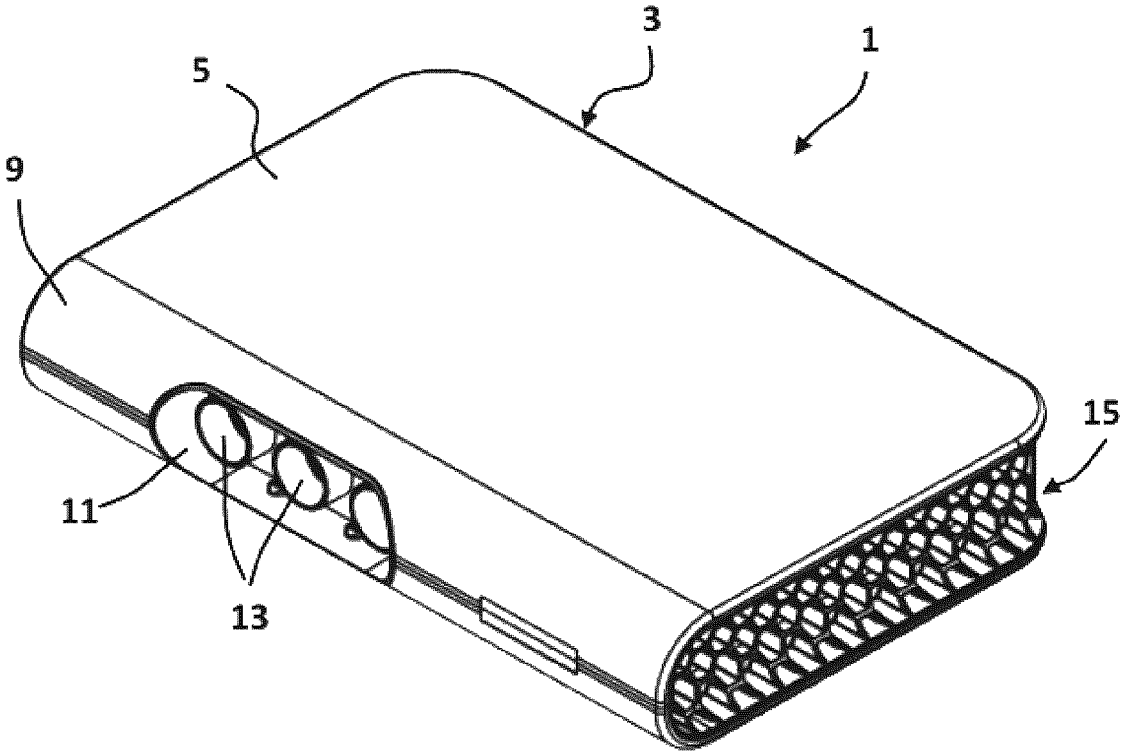
FIG. 1 is a top perspective view of an apparatus in accordance with a preferred embodiment.
Figure 2:
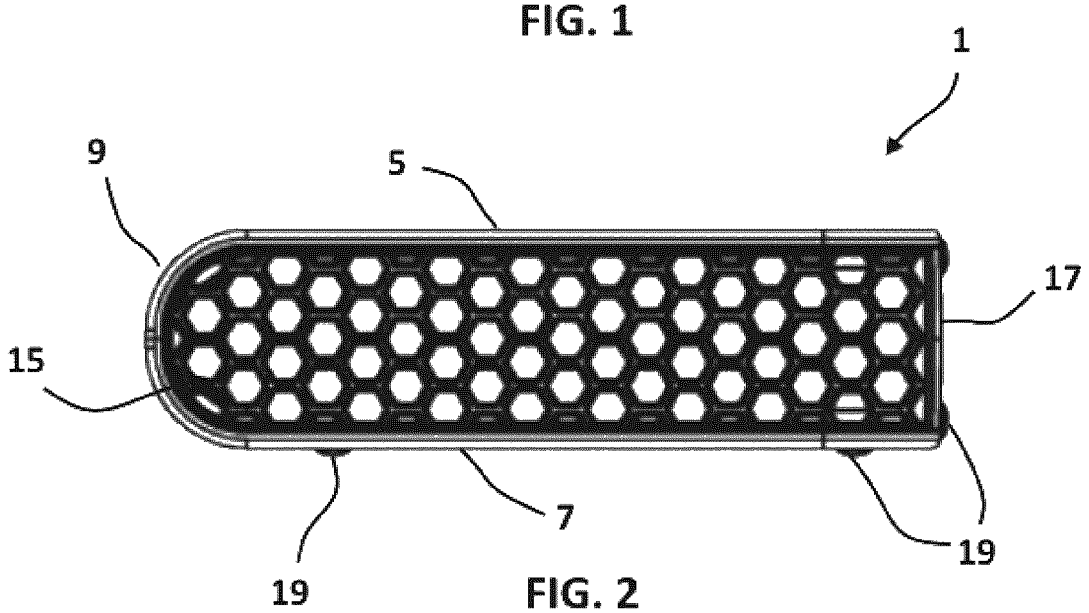
FIG. 2 is plan side view of the apparatus illustrated on FIG. 1.

FIGS. 1 to 4 illustrate an apparatus 1 that provides air and/or heated air to a bedding control system according to a preferred embodiment. The apparatus 1 comprises a casing 3 for encasing and supporting an electrically powered blower unit as the one detailed in FIGS. 6A to 6D.

The casing 3 defines a top flat surface 5, a bottom flat surface 7 and a front wall 9 connecting the top and bottom surfaces. The front wall 9 defines an aperture 11 configured to nest up to 3 air flow outlets 13 of the blower unit.

The casing 3 also defines lateral walls 15 and 16 extending from the top to the bottom surfaces. Each of the lateral walls comprises a grid element. The functionality of the grid elements will be better described herein after in reference to FIGS. 7A, 7B, 8A and 8B. The grid elements are generally made of a translucent plastic material and the apparatus may include LED lights located inside the casing and adjacent to the grid elements to produce light of different colors and intensity when the apparatus is working.

Figure 3:
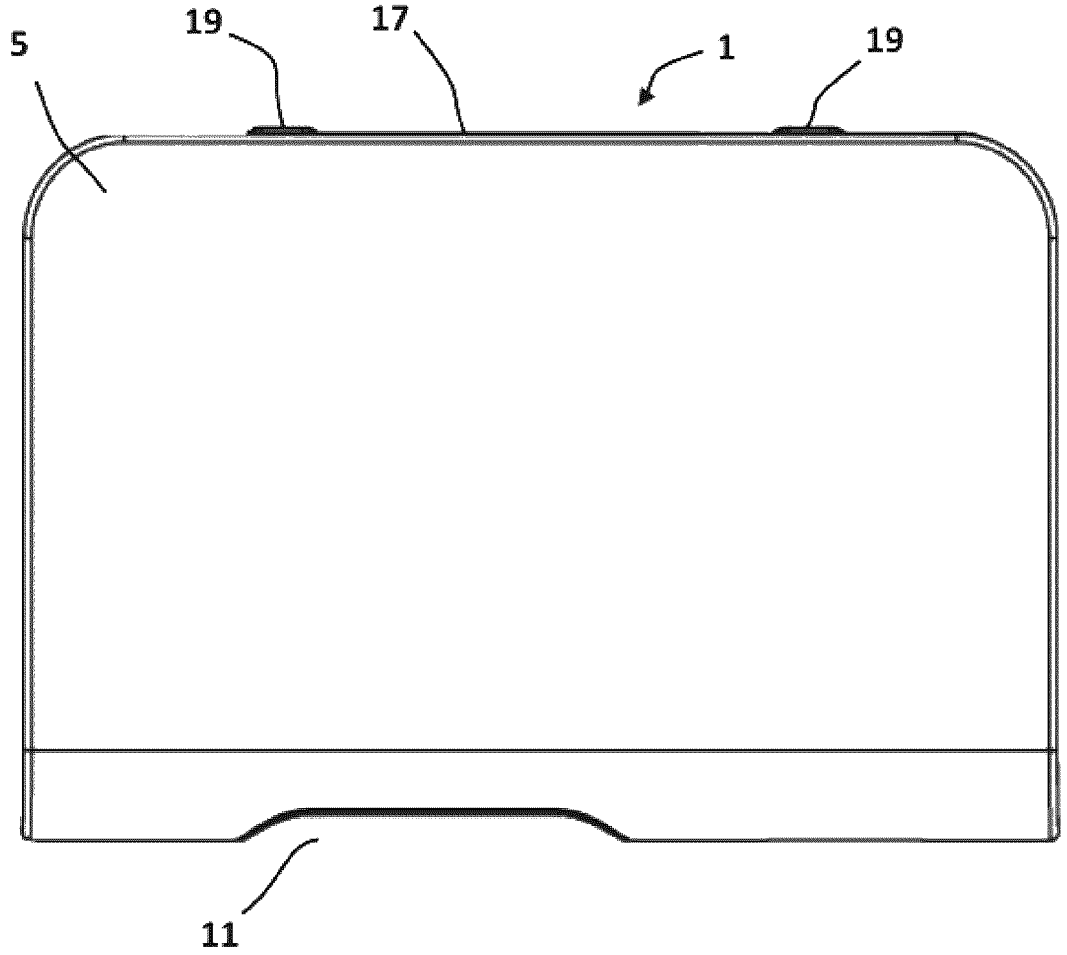
FIG. 3 is a top plan view of the apparatus illustrated on FIG. 1.
Figure 4:
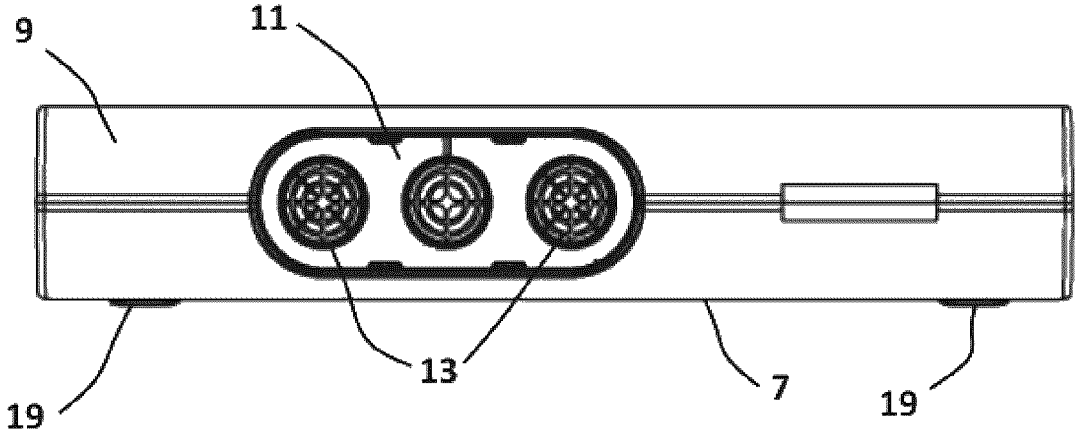
FIG. 4 is a front plan view of the apparatus illustrated on FIG. 1.

As illustrated on FIG. 3, the casing 3 also defines a back wall 17 extending from the top to the bottom surfaces, and from which may extend an electrical cable for powering the apparatus (not illustrated). The apparatus may also have feet 19, such as anti-slip rubber feet, extending from the bottom surface 7, or from the back wall 17 allowing the apparatus 1 to stand on the back wall.

Figure 5:
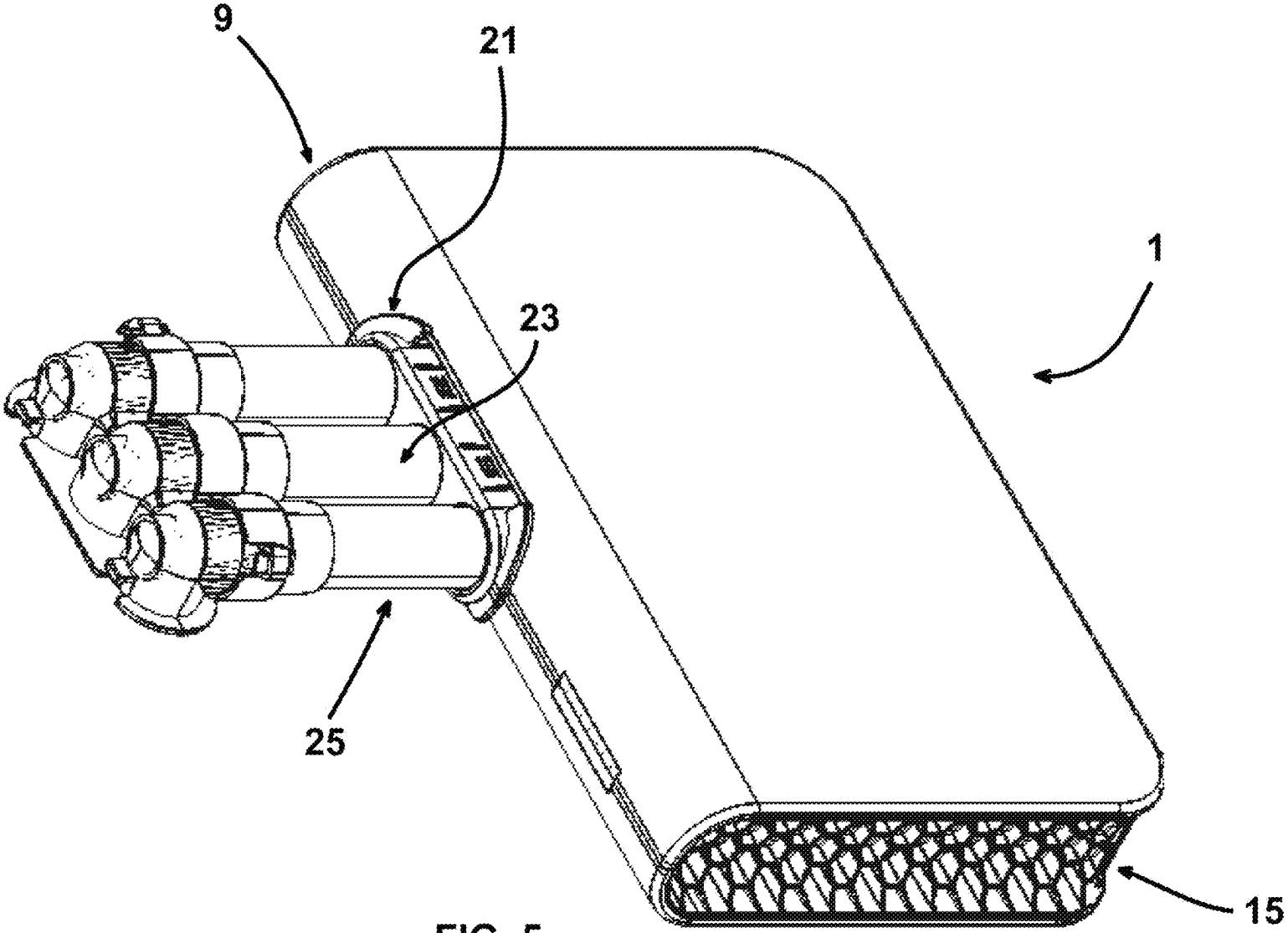
FIG. 5 is a top perspective view of the apparatus in accordance with a preferred embodiment including pipe connectors.
Figure 6A:
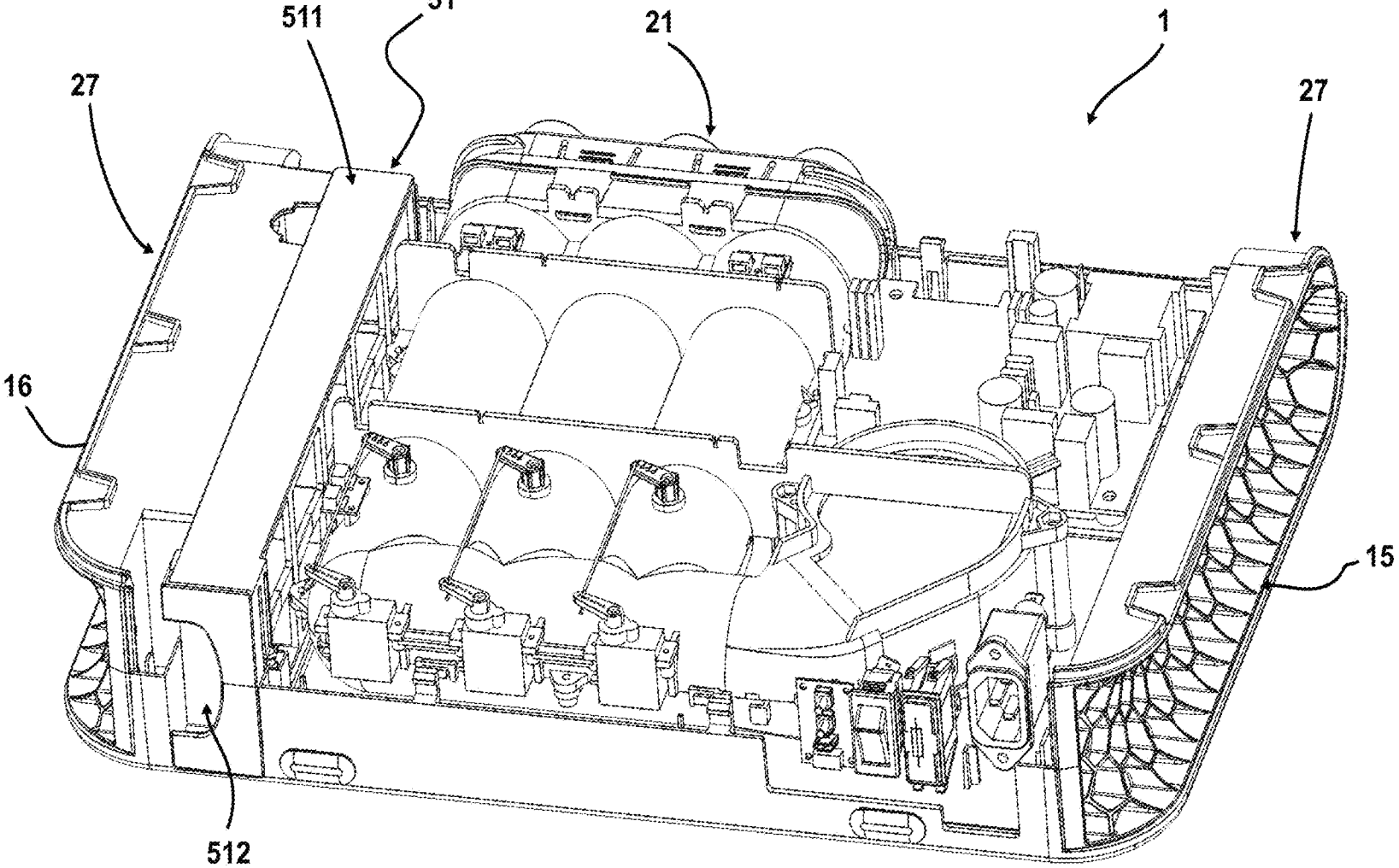
FIG. 6A is a top open view of the apparatus according to a preferred embodiment.

As illustrated on FIGS. 5 and 6A, the apparatus 1 may further comprise a connecting element 21 that is configured to be inserted and maintained into the aperture 11 of the front wall 9, for instance by clipping. The connecting element comprises tubular portions 23 for matching and aligning with the air flow outlets 13. The tubular portions are each sized to operatively connect with a respective pipe 25 for distributing air and/or heat to the device in need of said air and/or heat.

FIG. 6A shows an open casing 3 detailing the internal electrically powered blower unit, and in particular the grid elements 27 and 28 forming the lateral walls 15 and 16 respectively.

Figure 7A:
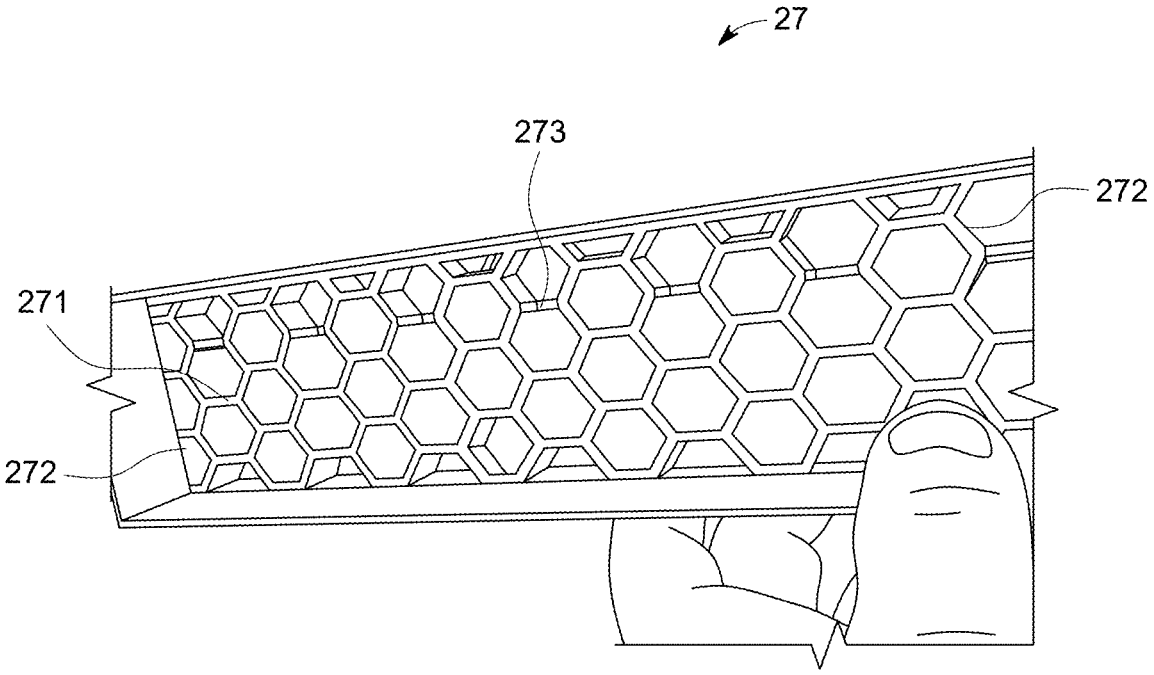
FIG. 7A is picture illustrating the front face of the honeycomb grid with air flow orifices according to a preferred embodiment.
Figure 7B:
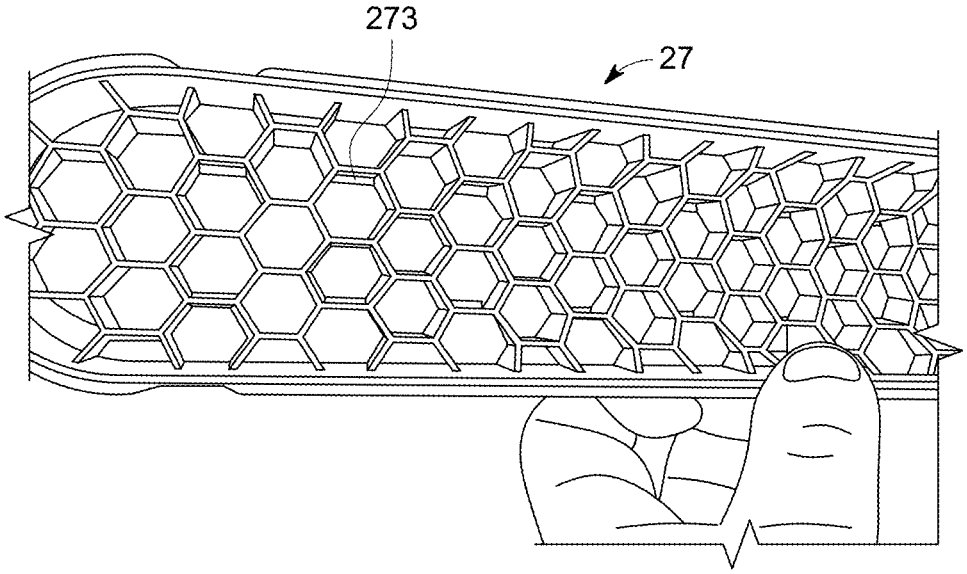
FIG. 7B is picture illustrating the back face of the honeycomb grid with air flow orifices according to a preferred embodiment.
Figure 8A:
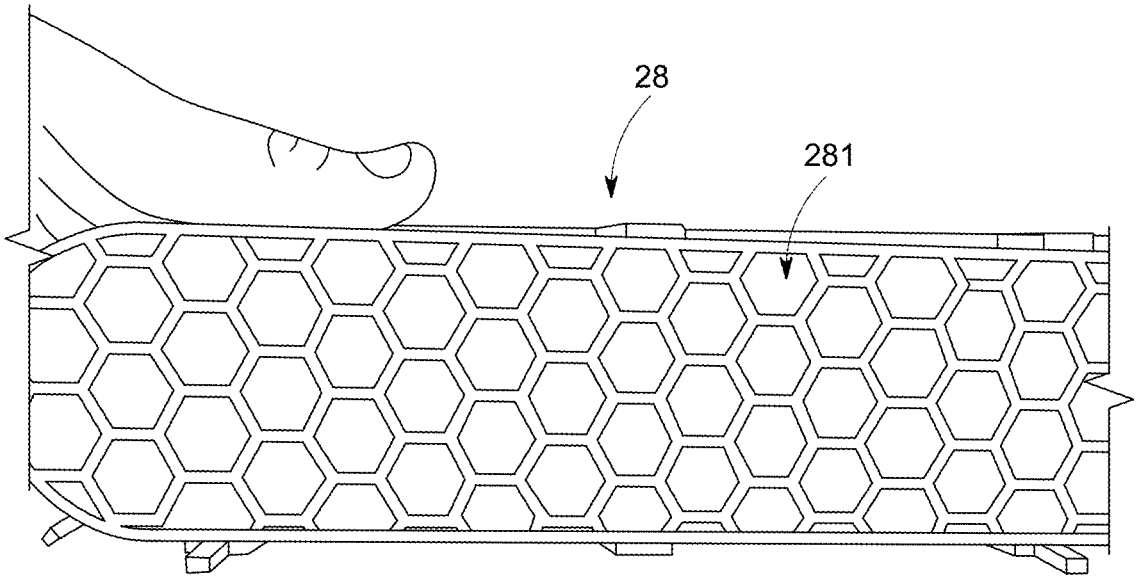
FIG. 8A is picture illustrating the front face of the honeycomb grid without air flow orifices according to a preferred embodiment.
Figure 8B:
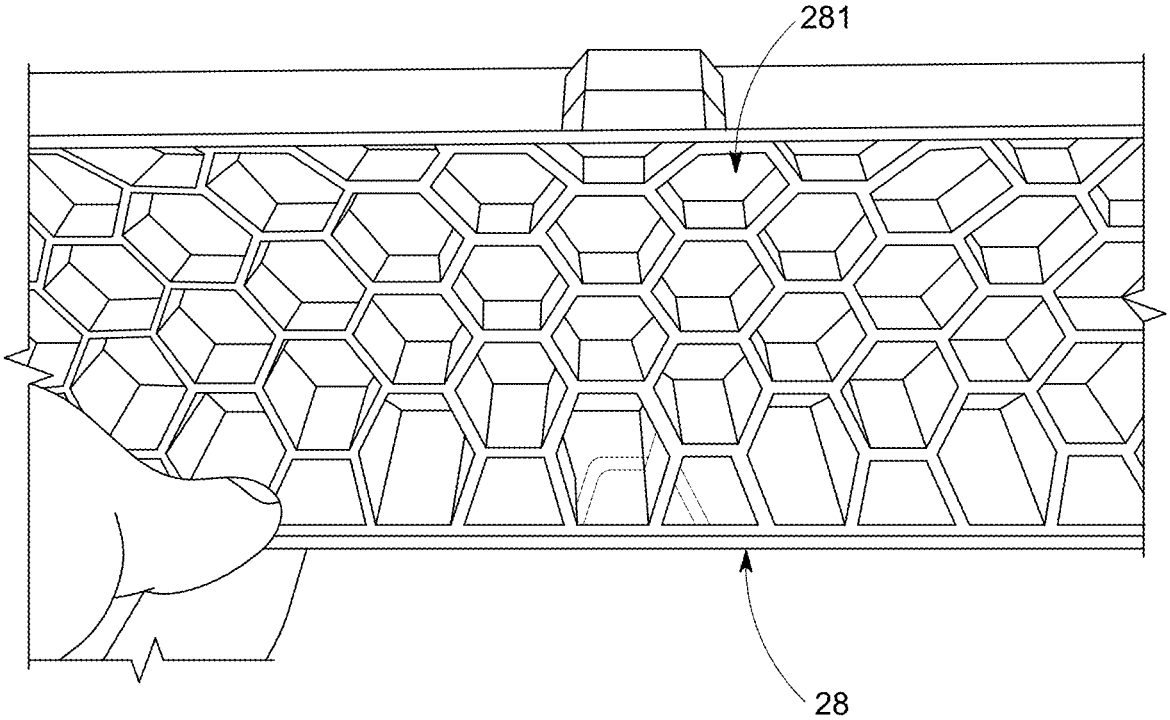
FIG. 8B is picture illustrating the back face of the honeycomb grid without air flow orifices according to a preferred embodiment.

The grid elements 27, 28 are generally made of a one-piece molded plastic material and are configured to be maintained by the casing, for instance by clipping. According to a preferred embodiment illustrated in FIGS. 7A to 8B, the first and second grid element 27, 28 have a 3-D honeycomb pattern. FIG. 7A shows the external face of the first grid element 27 having a flat central portion 271 of closed honeycomb cells surrounded by an upper and lower row 272 of open honeycomb cells forming vertical openings 273 for allowing air to flow inside the apparatus 1. In this regard, the first grid element 27 having air flow openings is located adjacent to the air outlets 311, 312, 313 whereas the opposite second grid element 28, as illustrated in FIGS. 8A and 8B, and which is adjacent to the blower unit 29, is made of closed honeycomb cells 281 which does not comprise air flow openings. The air entering the casing 3 of the apparatus 1 through the first grid element 27 is forced to flow above or below the outlets before reaching the blower unit 29. This configuration of the grid elements 27, 28 allows reducing noise propagation when the apparatus is running.

As illustrated in FIG. 6A, the apparatus 1 also comprises a filtering element 51 comprising a case 511 embedding a filter (not visible). The filter is facing the grid element 27 and thus allows filtering the air entering the casing when the apparatus is running for removing dust or the like. The case 511 comprises a handle portion 512 allowing to remove the case 511 from the casing 3 when the filter needs to be changed.

Figure 6B:
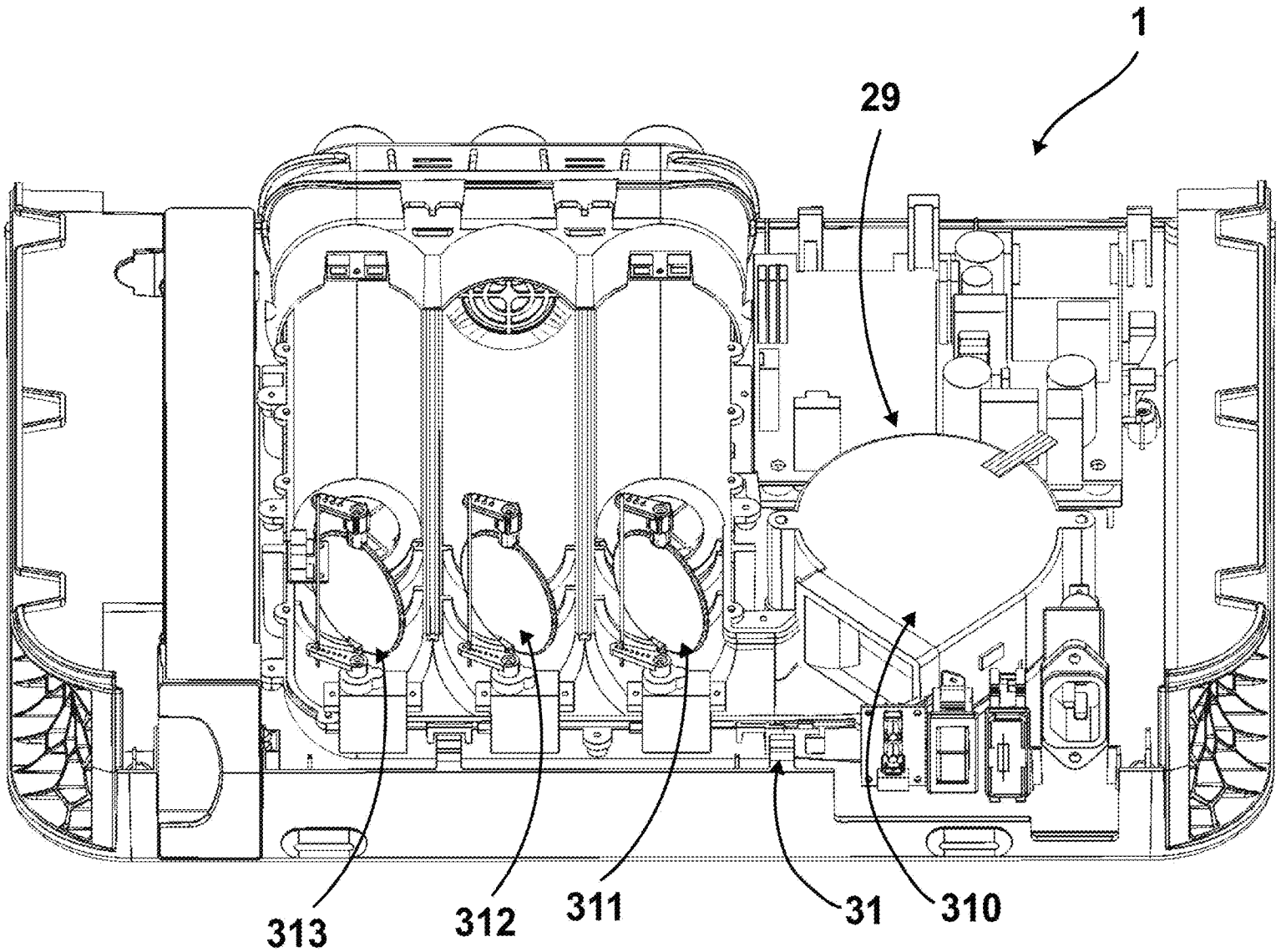
FIG. 6B is another top open view of the apparatus according to a preferred embodiment.

FIG. 6B shows an open casing 3 detailing the internal electrically powered blower unit, and in particular a centrifugal blower unit 29, electrically powered, to generate air flow. The centrifugal blower unit 29 is operatively connected to a main air conduit 31 having one inlet 310 in fluid communication with the blower unit 29 and a plurality of outlets 311, 312, 313.

Figure 6C:
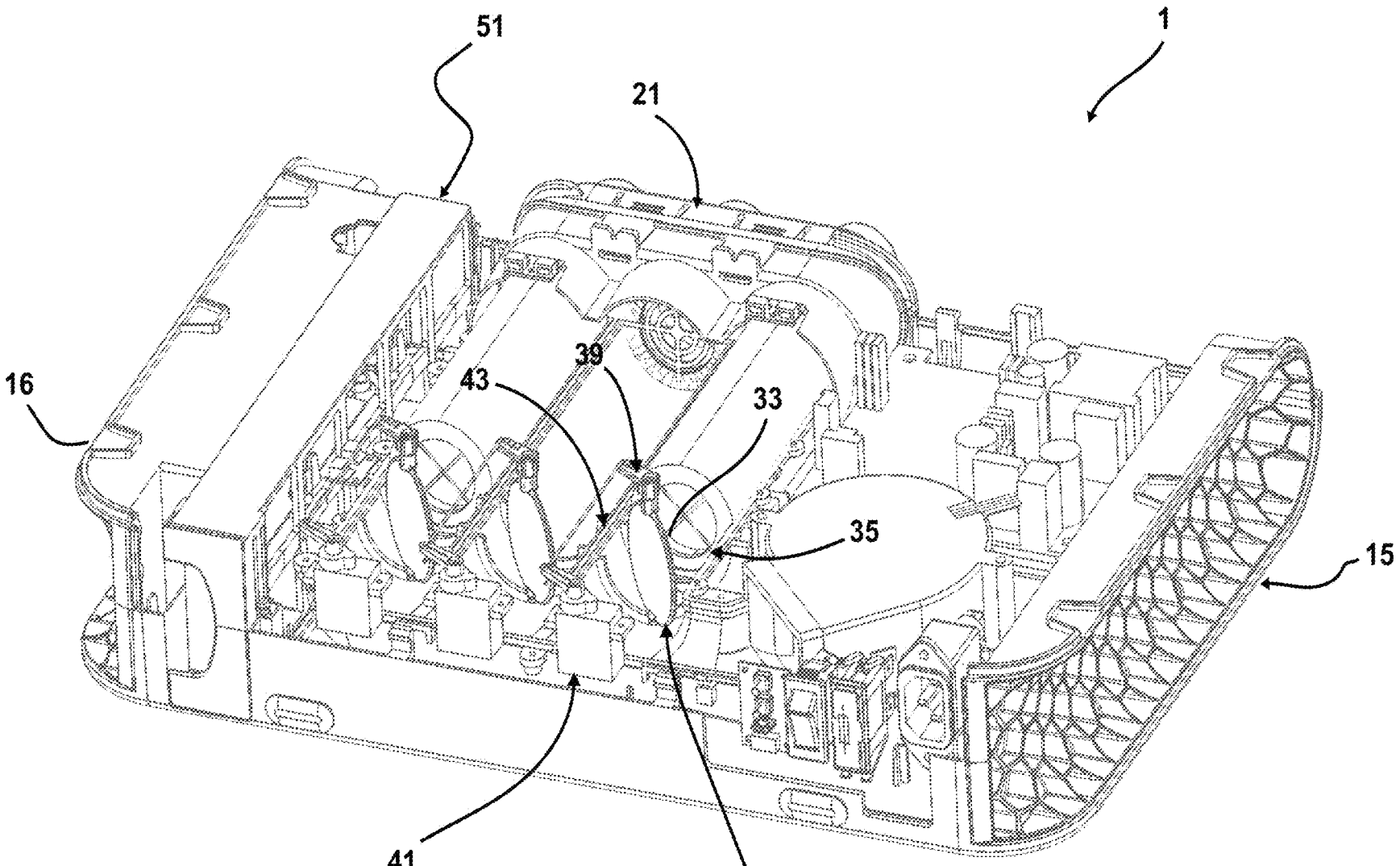
FIG. 6C is yet another top open view of the apparatus according to a preferred embodiment.

As illustrated on FIG. 6C, each of the outlets 311, 312, 313 define a chamber 33 in fluid communication with the main conduit 31. Each of the chambers 33 comprises a valve 35 which, in its closed position, closes the chamber to avoid air to enter the outlets. As illustrated, each valve 35 may comprise a revolving disc 37 fitting in size with the tubular section of the chamber 33. The disc is maintained inside the chamber by a vertical pivot 39 allowing the disc to rotate inside the chamber between a closed position when the disc 37 closes the chamber 33, and an full open position where the disc is parallel to the air flow. The position of the disc between the close and full open positions can be modified and maintained in its position to modulate the air flow. The disc can be moved via an actuator comprising a (micro-) motorized element 41 acting on the pivot of the disc via a cable 43. Each of the motorized element is independent one to the other.

Figure 6D:
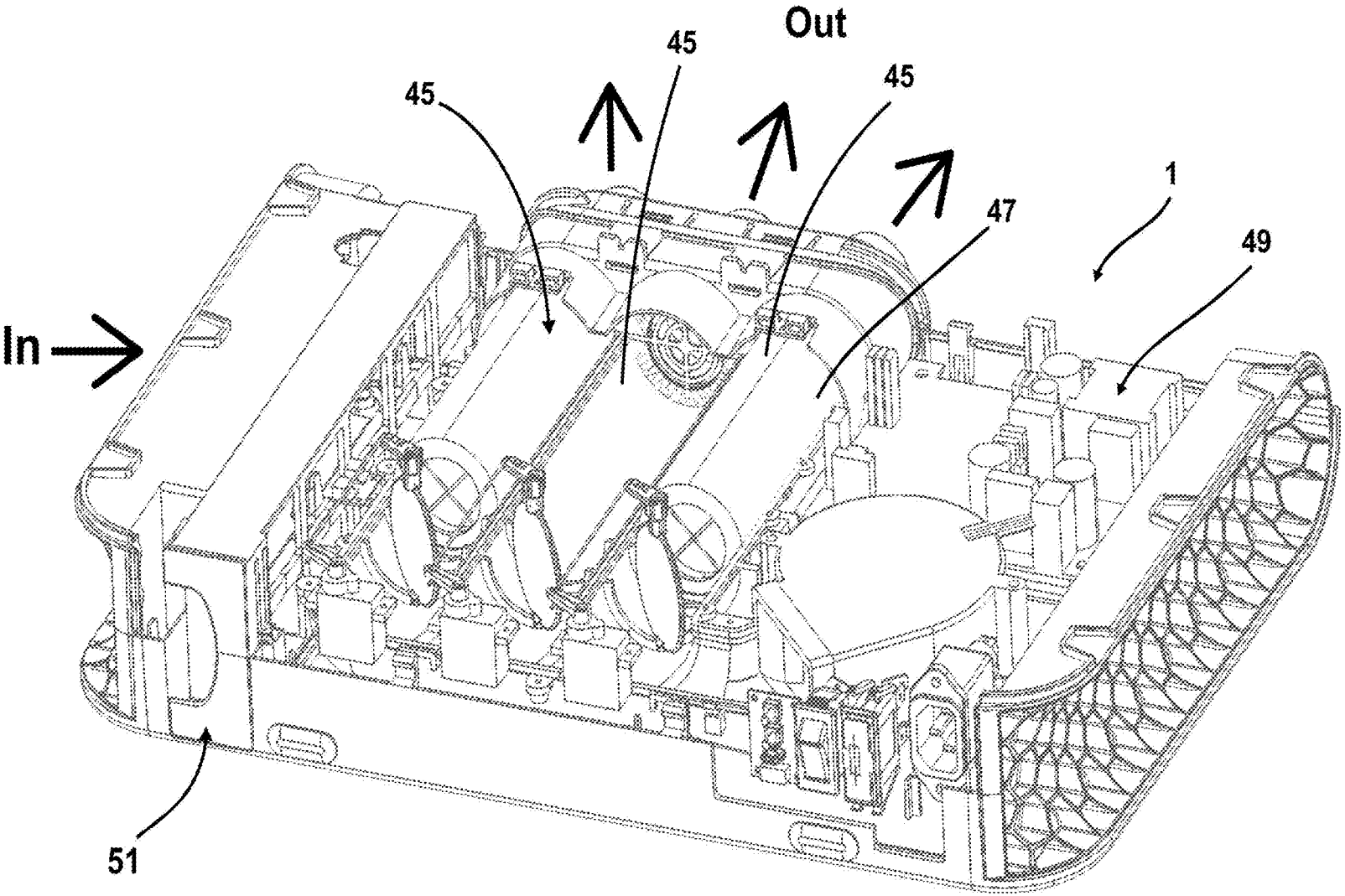
FIG. 6D is a further top open view of the apparatus according to a preferred embodiment.

As illustrated on FIG. 6D, each chambers 33 fluidly communicates with a longitudinal tubular portion 45 ended with the air flow outlets 13. At least one of the tubular portions comprises a heating element 47 for heating the air flowing through the tubular portion. The heating element as illustrated can surround the tubular portion. Each of the heating element is independent one to the other.

The apparatus 1 further comprises an electronic control unit 49, comprising for instance a printed circuit board (PCB), operatively connected to:

the blower unit for controlling the power of the blower (on/off) and eventually the air flow;

to each of the actuators of the valves 35 for controlling the opening and closing of the valve, and air flow; and to each of said heating elements 47 for heating or not the air going through the longitudinal tubular portion 45.

The electronic control unit can be operated using:

an interface located on an outside surface of the casing; and/or a smartphone, tablet or computer including an application or software adapted for wirelessly sending instructions to the apparatus, the connection can be using Bluetooth or Wi-Fi; and/or a remote control.

Figure 9:
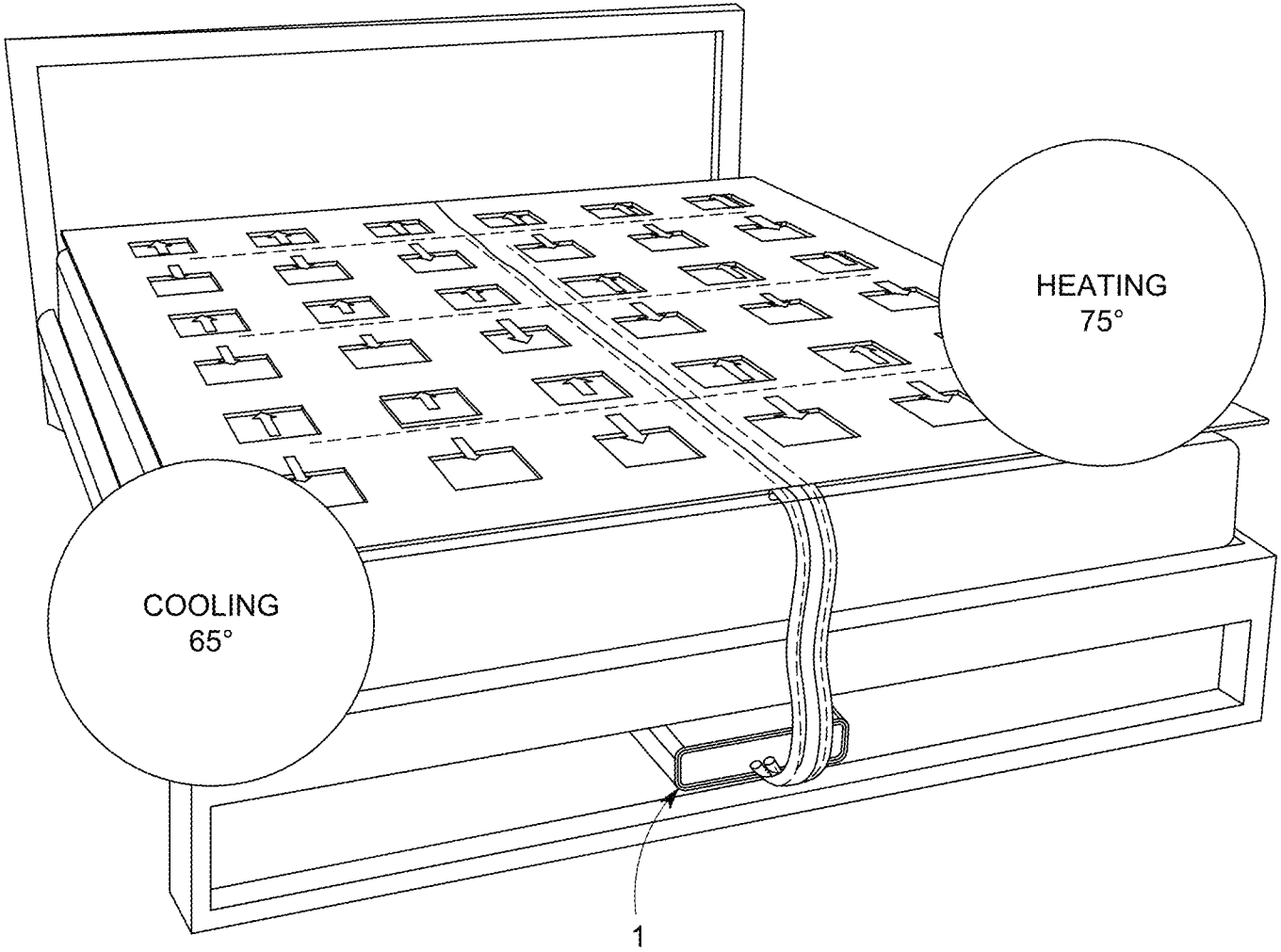
FIG. 9 schematizes a bed having a blower in accordance with a preferred embodiment connected to a bedding climate system.
Figure 11:
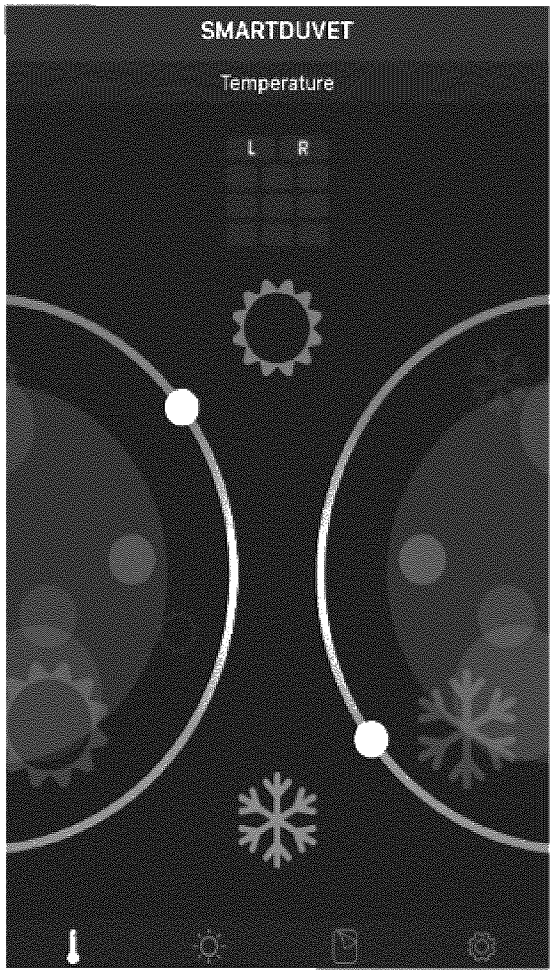
FIG. 11 illustrates a second interface of an application of a smartphone for controlling the bedding climate system.
Figure 10:
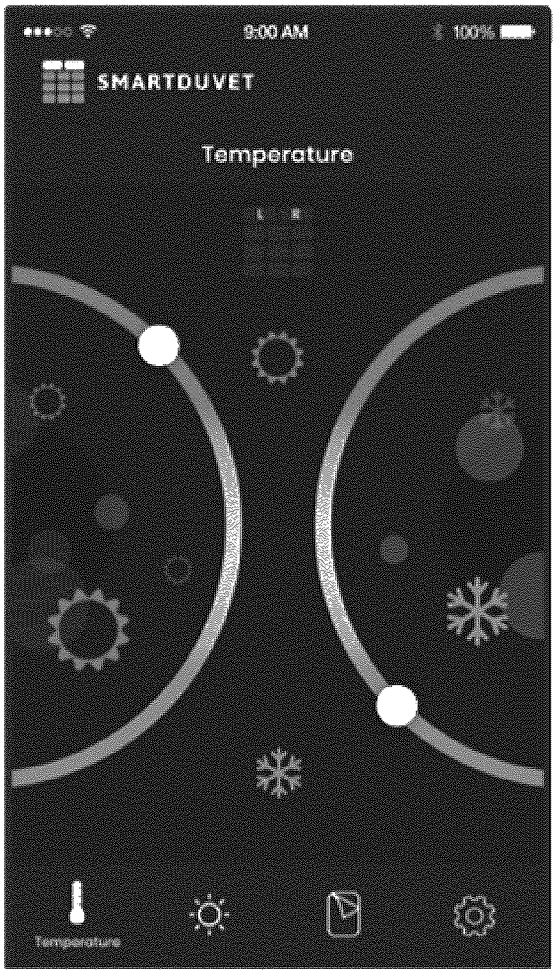
FIG. 10 illustrates a first interface of an application of a smartphone for controlling the bedding climate system.
Figure 12:
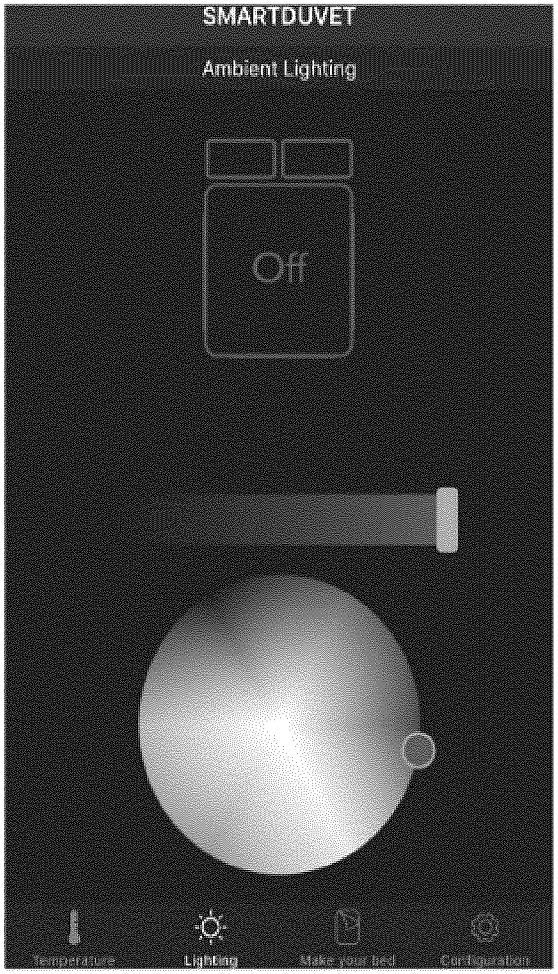
FIG. 12 illustrates a third interface of an application of a smartphone for controlling the bedding climate system.
Figure 13:
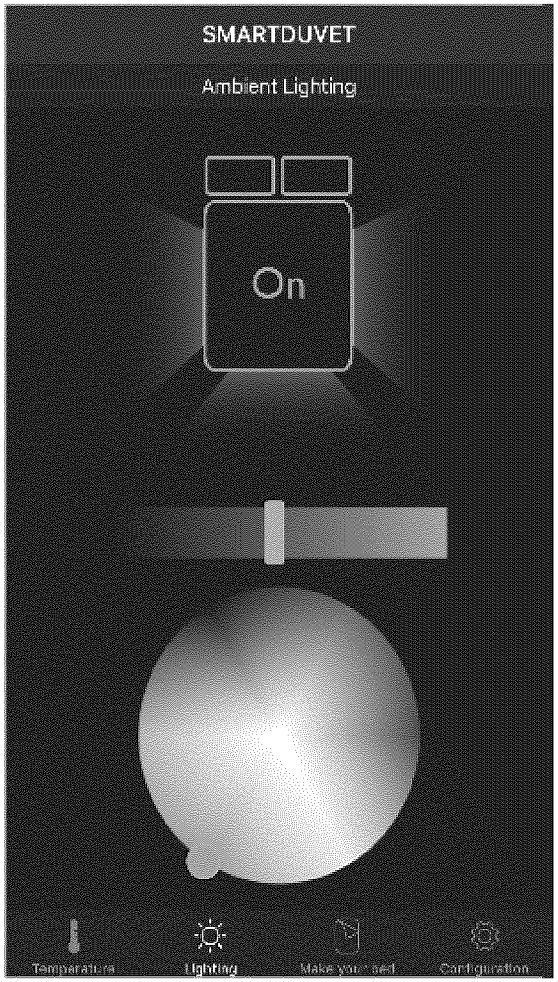
FIG. 13 illustrates a fourth interface of an application of a smartphone for controlling the bedding climate system.
Figure 14:
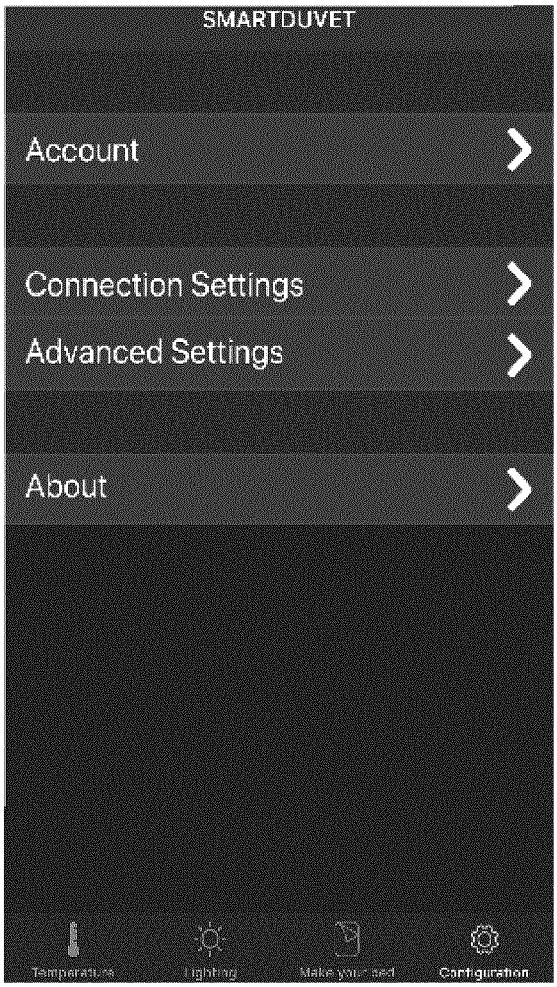
FIG. 14 illustrates a fifth interface of an application of a smartphone for controlling the bedding climate system.

FIGS. 10 to 16 shows examples of different interfaces of the application for controlling the self-making bedding system and the bedding climate system illustrated on FIG. 9.

Figure 17:
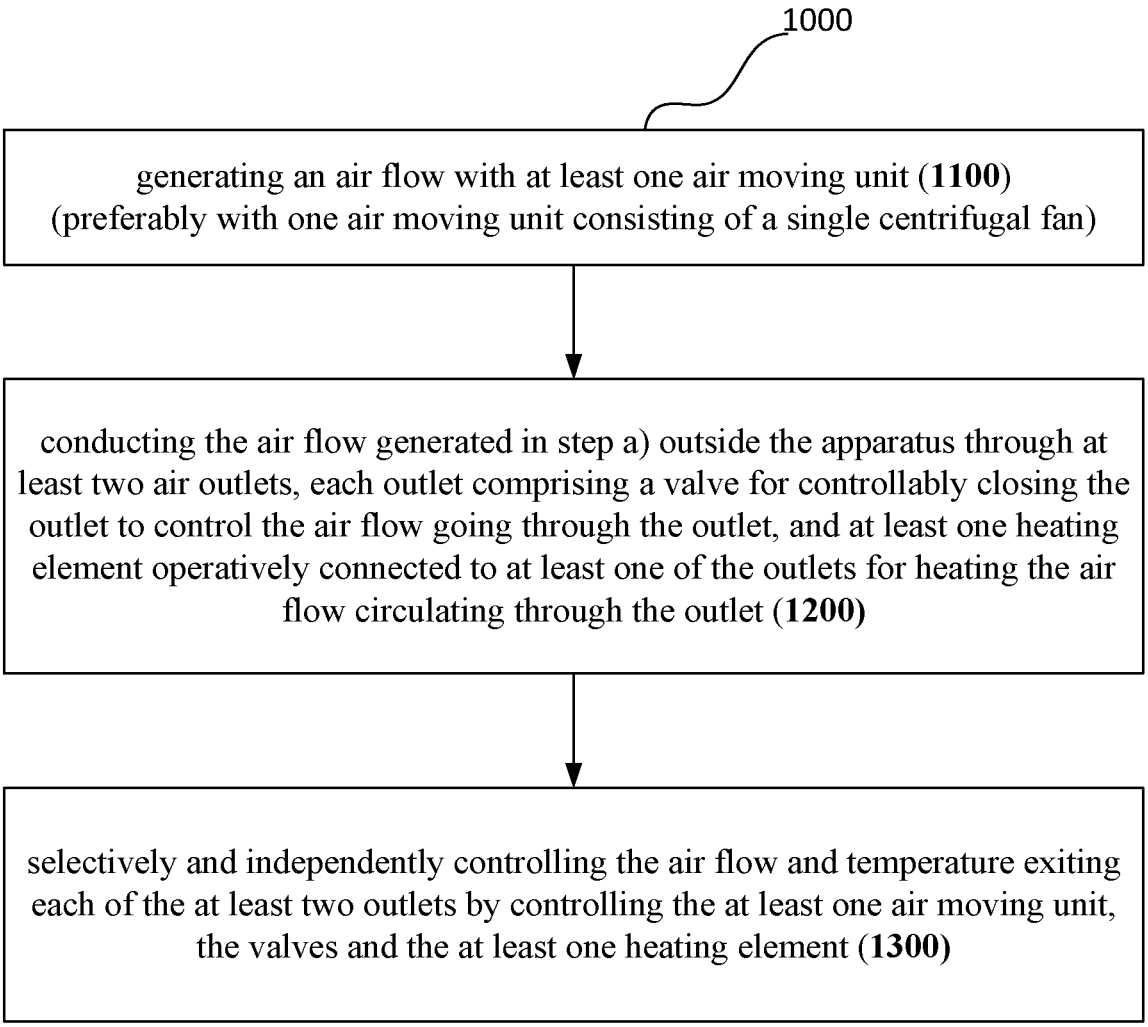
FIG. 17 is a flowchart for illustrating the method according to a preferred embodiment of the invention.

FIG. 17 illustrates the method for producing controlled air flows with different temperatures according to a preferred embodiment. The method 1000 comprises:

a) generating an air flow with at least one air moving unit (preferably with one air moving unit consisting of a single centrifugal fan) 1100;

b) conducting the air flow generated in step a) outside the apparatus through at least two air outlets, each outlet comprising a valve for controllably closing the outlet to control the air flow going through the outlet, and at least one heating element operatively connected to at least one of the outlets for heating the air flow circulating through the outlet 1200; and c) selectively and independently controlling the air flow and temperature exiting each of the at least two outlets by controlling the at least one air moving unit, the valves and the at least one heating element 1300.

The apparatus and method as disclosed herein allow producing air flow to inflate an inflatable element, such as a self-making bedding system, via a first exhausting pipe while heating or not the air exiting the apparatus via a second, optionally a third, exhausting pipe, for controlling the temperature sent into the inflatable element. The invention cannot be limited in accordance with the number of exhausting pipes.

In the preferred embodiment illustrated herein, the apparatus comprises three air flow outlets. The central outlet 46 does not include a heating element and is generally used for inflating the self-making bed system when the apparatus 1 is used for self-making the bed as detailed in WO 2018/064776, the content of which is enclosed herewith. The two other outlets are used to send temperature controlled air in the second chambers of the bedding climate control system for independently controlling the temperature on each side of the bed (see FIG. 9).

Figure 15:
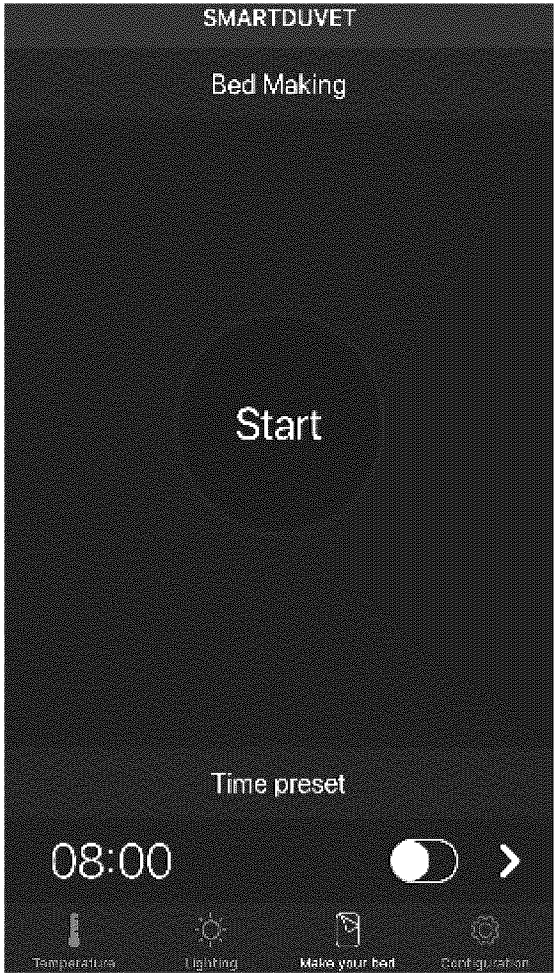
FIG. 15 illustrates a sixth interface of an application of a smartphone for controlling the bedding climate system.
Figure 16:
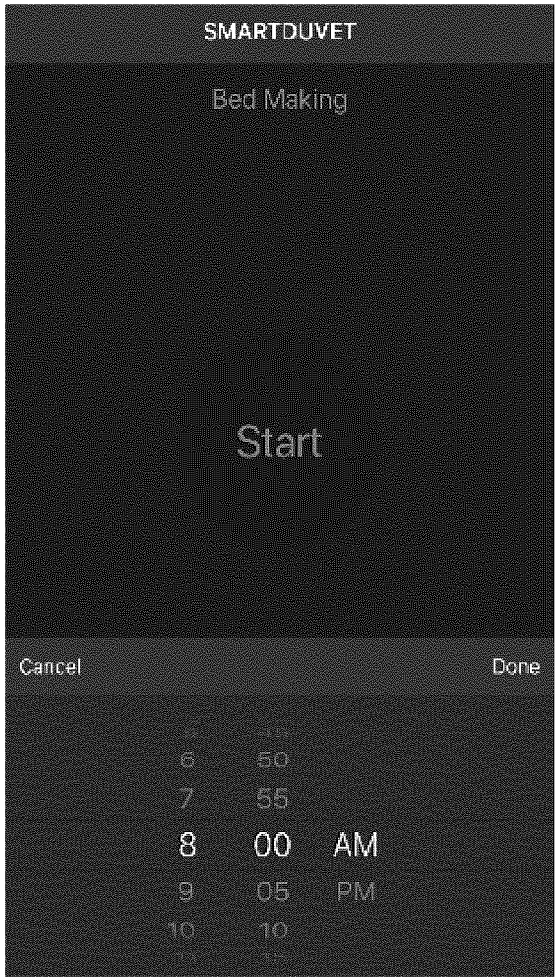
FIG. 16 illustrates a seventh interface of an application of a smartphone for controlling the bedding climate system.

By using a smartphone, a tablet, an intelligent virtual/personal assistant, a remote control or the like, operatively connected with the apparatus 1, one can modulate the temperature of the air sent to one side of the bed by modifying the air flow (opening of the valve) and/or the temperature of the heating elements. In that case, the central outlet is closed. When the user wants the self-making bedding system works and makes the bed, the central outlet is open while the two other outlets with the heating elements are closed to inject a maximum of air flow into the bedding system. The application controlling the apparatus may also be used for programming when the apparatus will start (FIGS. 15 and 16). For instance, the bed may be heated during several minutes before bedtime.

The present invention in combination with the self-making bedding system of the Applicant (WO2018/064776) is useful not only for normal use at home but also in combination with medical beds at home or in hospitals. The invention may be particularly useful for disabled persons allowing them to self-make their bed by directly controlling the apparatus via the application, with the possibility to use a voice control system combined with the application, or to have the apparatus daily programmed for making the bed or controlling the temperature at specific time of the day.

A method is generally conceived to be a self-consistent sequence of steps leading to a desired result. These steps require physical manipulations of physical quantities. Usually, though not necessarily, these quantities take the form of electrical or magnetic/electromagnetic signals capable of being stored, transferred, combined, compared, and otherwise manipulated. It is convenient at times, principally for reasons of common usage, to refer to these signals as bits, values, parameters, items, elements, objects, symbols, characters, terms, numbers, or the like. It should be noted, however, that all of these terms and similar terms are to be associated with the appropriate physical quantities and are merely convenient labels applied to these quantities.

The description of the present invention has been presented for purposes of illustration but is not intended to be exhaustive or limited to the disclosed embodiments. Many modifications and variations will be apparent to those of ordinary skill in the art. The embodiments were chosen to explain the principles of the invention and its practical applications and to enable others of ordinary skill in the art to understand the invention in order to implement various embodiments with various modifications as might be suited to other contemplated uses.

What is claimed is:

1. An apparatus for producing controlled air flows with different temperatures, the apparatus comprising:

a blower unit having at least one air moving unit to generate air flow;

an outlet unit comprising a first and second air outlets fluidly connected to the blower unit and configured for providing the air flow outside the apparatus, each of said first and second air outlets comprising a valve for controllably closing the outlet to control the air flow going through the outlet;

a heating unit comprising one heating element operatively connected to said first air outlet for heating the air flow circulating through the first air outlet whereas the second air outlet is free of said heating element; and a control unit operatively connected to the at least one air moving unit, to the valves and to said heating element, for selectively controlling the air flow and temperature exiting the first air outlet and the air flow exiting the second air outlet;

wherein each of said first and second air outlets comprises:

a first chamber in fluid communication with the blower unit, and a second chamber in fluid communication with the first chamber and configured for providing the air flow outside the apparatus;

wherein the valve is configured to controllably close the first chamber to avoid the air flow generated by the blower unit to enter the first chamber;

wherein the first and second chambers form a continuous tubular element defining a tubular section with a cylindrical surface, and wherein the heating element is located around the cylindrical surface of the second chamber.

2. The apparatus as claimed in claim 1, wherein the air moving unit consists of a single centrifugal fan.

3. The apparatus as claimed in claim 1, further comprising a third air outlet identical and adjacent to the first and second air outlets and another heating element located around the cylindrical surface of the second chamber of the third outlet; wherein the control unit allows selectively controlling the air flow and temperature exiting the first and third air outlets and the air flow exiting the second air outlet.

4. The apparatus as claimed in claim 3, wherein the heating elements are independently controlled one to the other.

5. The apparatus as claimed in claim 3, further comprising a longitudinal distribution pipe for connecting the first, second and third air outlets to the blower unit defining a longitudinal direction, the first, second and third air outlets being fluidly connected along the distributions pipe and perpendicularly oriented to the longitudinal direction of the distribution pipe.

6. The apparatus as claimed in claim 3, wherein the valve comprises a revolving disc fitting in size with the tubular section of the first chamber, the revolving disc being maintained inside the first chamber by a vertical pivot allowing the revolving disc to rotate inside the first chamber between a closed position, when the disc closes the first chamber and blocks the air flow, and a full open position, when the disc is parallel to a direction of the air flow, the disc being maintained according to an operative position between the close and full open positions, the operative position being controllably modified by the control unit for modulating the air flow.

7. The apparatus as claimed in claim 1, wherein the valve comprises a revolving disc fitting in size with the tubular section of the first chamber, the revolving disc being maintained inside the first chamber by a vertical pivot allowing the revolving disc to rotate inside the first chamber between a closed position, when the disc closes the first chamber and blocks the air flow, and a full open position, when the disc is parallel to a direction of the air flow, the disc being maintained according to an operative position between the close and full open positions, the operative position being controllably modified by the control unit for modulating the air flow.

8. The apparatus as claimed in claim 7, wherein each disc of each valve is rotated via an actuator comprising a micro-motorized element operatively controlled by the control unit and acting on the vertical pivot of the disc via a cable, each of the motorized element being independent one to the other.

9. The apparatus as claimed in claim 8, wherein the control unit comprises an electronic control system having a printed circuit board (PCB) operatively connected to:

the blower unit for controlling a power of the least one air moving unit (on/off) and optionally the air flow;

each actuator of the valve for controlling and maintaining the operative position of the valve, and as such control the air flow in each second chamber independently one to the other; and to the heating element for heating or not the air going through the second chamber of the first outlet.

10. The apparatus as claimed in claim 9, wherein the electronic control system is operated using at least one of the followings:

an interface located on an outside surface of the apparatus;

a smartphone, a tablet, an intelligent virtual/personal assistant, or computer including an application or software adapted for wirelessly sending instructions to the apparatus; and a remote control.

11. The apparatus as claimed in claim 10, wherein the instructions are wirelessly sent using Bluetooth or Wi-Fi.

12. The apparatus as claimed in claim 1, further comprising:

a casing for supporting the blower unit, the outlet unit, the heating unit and the control unit; and a grid element extending from a first side of the casing adjacent to the outlet unit, the grid element having at least one air flow opening for allowing air entering the casing;

wherein a second side of the casing opposite to the first side is located adjacent to the blower unit, the air entering the casing of the apparatus through the first grid element being then forced to flow above or below the outlets before reaching the blower unit, in order to reduce noise propagation when the apparatus is running.

13. An apparatus for producing controlled air flows with different temperatures, the apparatus comprising:

a blower unit having at least one air moving unit to generate air flow;

an outlet unit comprising three air outlets fluidly connected to the blower unit and configured for providing the air flow outside the apparatus, each of said three air outlets comprising a valve for controllably closing the outlet to control the air flow going through the outlet;

a heating unit comprising two heating elements, each of the two heating elements being operatively connected to one of the three air outlets for heating the air flow circulating therethrough;

a control unit operatively connected to the at least one air moving unit, to the valves and to the two heating elements, for selectively controlling the air flow and temperature exiting each of the at least two air outlets;

wherein each of the three outlets comprises:

a first chamber in fluid communication with the blower unit, and a second chamber in fluid communication with the first chamber and configured for providing the air flow outside the apparatus;

wherein the valve is configured to controllably close the first chamber to avoid the air flow generated by the blower unit to enter the first chamber;

wherein the first and second chambers form a continuous tubular element defining a tubular section with a cylindrical surface, and wherein the valve comprises a revolving disc fitting in size with the tubular section of the first chamber, the revolving disc being maintained inside the first chamber by a vertical pivot allowing the revolving disc to rotate inside the first chamber between a closed position with the disc closing the first chamber and blocking the air flow, and a full open position with the disc being parallel to a direction of the air flow, the disc being maintained according to an operative position between the closed and full open positions, the operative position being controllably modified by the control unit for modulating the air flow.

14. The apparatus as claimed in claim 13, further comprising a longitudinal distribution pipe for connecting the three outlets to the blower unit defining a longitudinal direction, wherein the three outlets are fluidly connected along the distributions pipe and perpendicularly oriented to the longitudinal direction of the distribution pipe.

15. The apparatus as claimed in claim 13, wherein each of the at least two heating elements is located around the cylindrical surface of the second chamber.

16. The apparatus as claimed in claim 13, further comprising:

a casing for supporting the blower unit, the outlet unit, the heating unit and the control unit; and a grid element extending from a first side of the casing adjacent to the outlet unit, the grid element having at least one air flow opening for allowing air entering the casing;

wherein a second side of the casing opposite to the first side is located adjacent to the blower unit for forcing the air entering the casing of the apparatus through the first grid element to flow above or below the outlets before reaching the blower unit in order to reduce noise propagation when the apparatus is running.

17. The apparatus as claimed in claim 13, wherein each disc of each valve is rotated via an actuator comprising a micro-motorized element operatively controlled by the control unit and acting on the vertical pivot of the disc via a cable, each of the motorized element being independent one to the other.

18. The apparatus as claimed in claim 17, wherein the control unit comprises an electronic control system having a printed circuit board (PCB) operatively connected to:

the blower unit for controlling a power of the least one air moving unit (on/off) and optionally the air flow;

each actuator of the valve for controlling and maintaining the operative position of the valve, and as such control the air flow in each second chamber independently one to the other; and to the heating element for heating or not the air going through the second chamber of the first outlet.

19. The apparatus as claimed in claim 18, wherein the electronic control system is operated using at least one of the followings:

an interface located on an outside surface of the apparatus;

a smartphone, a tablet, an intelligent virtual/personal assistant, or computer including an application or software adapted for wirelessly sending instructions to the apparatus; and a remote control.

20. The apparatus as claimed in claim 19, wherein the instructions are wirelessly sent using Bluetooth or Wi-Fi.

* * * * *